United States Patent [19]

Wu

[11] 4,029,088

[45] June 14, 1977

[54] BIOLOGICAL TISSUE STRENGTHENING DEVICE

[76] Inventor: An-Chuan Wu, No. 217, Chien Kuo S. Rd., Taipei City, China /Taiwan

[22] Filed: June 18, 1975

[21] Appl. No.: 588,168

[52] U.S. Cl. ..... 128/38

[51] Int. Cl.[2] ..... A61H 1/00

[58] Field of Search ..... 128/38–40, 128/67, 281, 282, 25

[56] References Cited

UNITED STATES PATENTS

| | | | |
|---|---|---|---|
| 67,663 | 8/1867 | Mattson | 128/38 |
| 72,604 | 12/1867 | Cole | 128/281 |
| 1,312,619 | 8/1919 | D'Orsay | 128/40 |
| 1,599,628 | 9/1926 | Ahlgren | 128/38 X |
| 2,616,417 | 11/1952 | Holbrook | 128/38 |

FOREIGN PATENTS OR APPLICATIONS

| | | | |
|---|---|---|---|
| 686,367 | 1/1953 | United Kingdom | 128/281 |
| 16,448 | 7/1910 | United Kingdom | 128/281 |

*Primary Examiner*—Lawrence W. Trapp
*Attorney, Agent, or Firm*—Michael J. Striker

[57] ABSTRACT

A biological tissue strengthening device comprises a shape-retaining cup adapted to be placed over human breast tissue with clearance so as to define an interior space therewith, and means for evacuating air from the space and for drawing the breast tissue further into said cup, thereby exercising the breast tissue.

2 Claims, 4 Drawing Figures

BIOLOGICAL TISSUE STRENGTHENING DEVICE

BACKGROUND OF THE INVENTION

The present invention relates to a biological tissue strengthening device, and more particularly to a biological device for strengthening human breast tissue.

The strengthening or building up of biological tissue in the female human breast is a well-known problem in physiotherapy. One medical approach uses surgical techniques, such as breast implant operations, while nonsurgical techniques include the use of external creams or internal hormone preparations. The surgical technique is a relatively expensive medical operation and requires an extended hospital stay; the nonsurgical techniques have been found to be either totally ineffective or to cause harmful side effects.

Another medical approach has included hydrotherapy, wherein jets of pulsating water are directed to impinge upon the breast tissue. This approach has the disadvantage that the breast tissue is rather delicate and is easily damaged by such pulsating jets.

SUMMARY OF THE INVENTION

Accordingly, it is the general object of the present invention to overcome the disadvantages of the prior art.

More particularly, it is an object of the present invention to strengthen breast tissue so as to achieve a higher, fuller and firmer bustline.

A further object of the present invention is to provide an exercising device which is both safe to use and effective in operation.

In keeping with these objects and others which will become apparent hereinafter, one feature is the placement of a shape-retaining cup over a human breast with clearance so as to define an interior space therewith. Means for evacuating air from this interior space is connected with the shape-retaining cup so as to draw the breast further within the cup, and thereby to exercise the breast tissue. The shape-retaining feature of the cup assures that the biological tissue will be firmly and adequately drawn into the interior space.

Another feature is to make the shape-retaining cup of transparent material and to provide it with indicating means, such as gradations. Thus, the relative distance through which the breast is drawn into the interior space can be noted by the user. This data is useful for charting the progress and growth of the biological tissue as well as for serving as a guide for its safe operation so that the pressure developed by the air-evacuation means will not cause excessive physical stress on the tissue.

Another feature of the invention is to provide the air-evacuation means and the shape-retaining cup with an outlet having friction-retention means for retaining a flex-conduit thereto. The conduit is connected intermediate the shape-retaining cup and the air-evacuation means. The friction-retaining means assures that the ends of the flexible conduit will not become disengaged during the buildup and release of pressure by the air evacuating means.

Another feature of the invention is to provide cooperating valve means on a resilient pumping element. By squeezing opposite wall portions of the pumping element towards each other, a pressure condition will be created which either urges obstruction members mounted in air flow passages provided in the resilient element inwardly or outwardly of each other. This feature assures that a user may regulate and control the amount of air being evacuated, as desired.

A further feature is to provide means for adjustably admitting ambient air into the interior space and for releasing the vacuum condition therein. This feature assures that the breast will return to its original position within the cup due to its own inherent muscle tenacity.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 3:
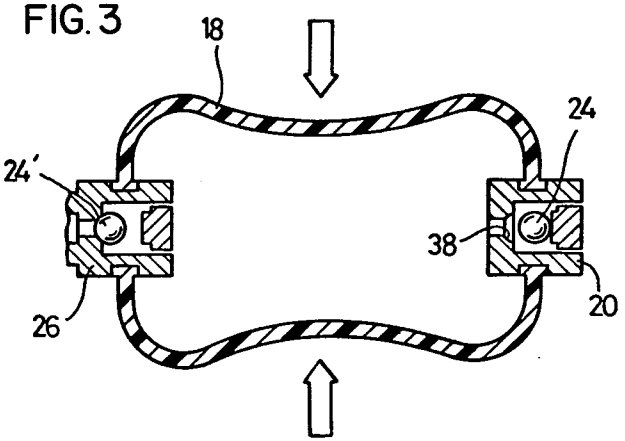
FIG. 3 is a sectional view showing a detail of the arrangement during one portion of the operational cycle.

Discussing the apparatus which has been illustrated in an exemplary embodiment in FIG. 1 through 4, it will be seen that reference numeral 10 identifies a shape-retaining cup adapted to be placed over biological breast tissue with clearance. The cup 10 is formed of any suitable shape-retaining material which is preferably transparent, for example, clear synthetic plastic material, glass or any glass-like thermoplastic resin material. Indicating means 42 is provided on the transparent cup 10 for indicating the distance through which the breast is drawn into the cup, as will be described herein.

Means for evacuating air from the interior space which is formed intermediate the breast tissue and the inner circumferential surface of the cup 10, comprises a resilient pumping element 18 which has opposite wall portions which define an interior region. Inlet valve 26 and outlet valve 20 are provided on the resilient pumping element 18.

The cup 10 is provided with an outlet 14 having a passage which is in constant communication with the aforementioned interior space defined by the cup 10. The inlet valve 26 has a valve housing 28 which accommodates a passage 30 which communicates with the above-mentioned interior region of the pumping element 18 depending upon the operation of the inlet valve 26.

The tubular element or conduit 36 is hollow and has one of its ends connected to the outlet 14 and the other of its ends connected to the valve housing 28. Friction-retention means 12, 16 and 34 are respectively provided on the outlet 14 and the valve housing 28 for frictionally retaining the ends of the tubular conduit 36. The tubular conduit 36 is preferably made of flexible material, such as rubber hosing, and is mounted in place by pushing its ends over the respective friction-retention means. Friction retention means 12 is tapered to ease and facilitate the mounting of the conduit 36;

and friction-retaining means 16 and 34 project outwardly so as to firmly engage the conduit 36 and prevent it from disengaging during the operation of the air-evacuating means.

Figure 4:
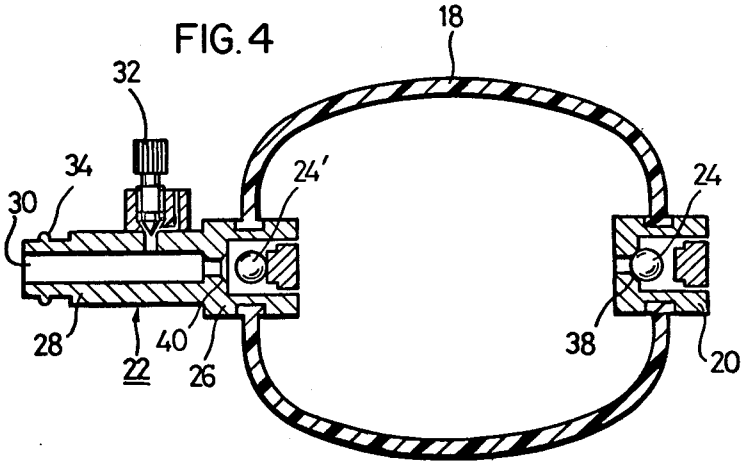
FIG. 4 is a sectional view showing a detail of the arrangement during another portion of the operational cycle.
Figure 1:
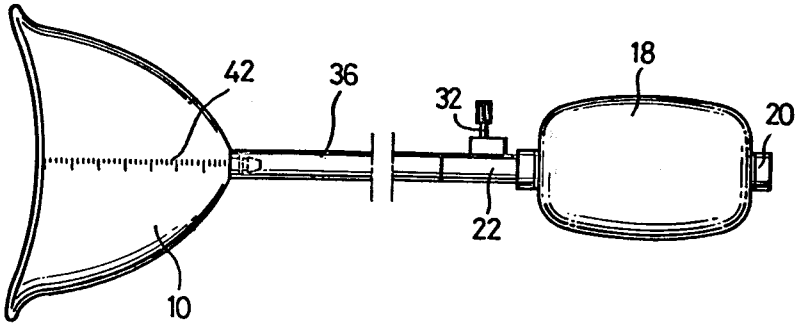
FIG. 1 is a diagrammatic side view of an apparatus according to the present invention.
Figure 2:
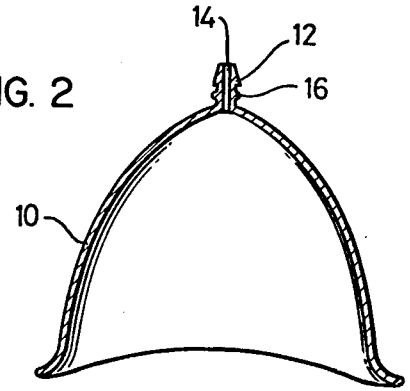
FIG. 2 is a sectional view of the shape-retaining cup.

Inlet valve 26 and outlet valve 20 are respectively provided with air flow passages and obstruction or valve members or bearings 24', 24 which are movably mounted so as to admit or prevent air from flowing in the air flow passages. The obstruction members 24', 24 are normally urged by biasing means, such as a spring or the like (not illustrated for purposes of clarity), into a first position in which the respective obstruction members 24', 24 are urged inwardly towards each other, as shown in FIG. 4.

Obstruction member 24 is urged to seat in its valve seat 38; whereas, obstruction member 24' is urged off of its valve seat 40. In this first position, the air in the interior space defined by the cup 10 is in direct communication with the interior region defined by the pumping element 18 since the obstruction member 24' does not block the passage 30. Moreover, in the first position, the air within the pumping element 18 cannot escape to the ambient atmosphere, because the obstruction member 24 prevents such passage.

By displacing the wall portions of the resilient pumping element 18 towards each other, in the direction of the arrows as illustrated in FIG. 3, a pressure differential will develop and the obstruction members 24', 24 will be urged outwardly away from each other. In this second air-evacuation position, obstruction member 24' is urged into its valve seat 40; and obstruction member 24 is urged off of its valve seat 38.

In this second position, the air within the pumping element 18 is in direct communication with the ambient atmosphere since the obstruction member 24 no longer blocks such passage. Moreover, in this second position, the air within the pumping element 18 cannot escape or be ejected back towards the cup 10, since the obstruction member 24' effectively blocks the passage 30 and prevents such passage.

Air-admitting means 22 is located on said conduit 36 intermediate said interior region defined by the cup 10 and the interior space defined by the pumping element 18. An adjustable element, such as a screw 32, is movably mounted in a bypass passage leading to the primary passage 30. Upon turning the adjustable element 32 in requisite direction, air from the ambient atmosphere is admitted into the primary passage 30. This action releases the vacuum condition created within the cup 10.

The adjusting element 32 preferably has a tapered cross section at its leading end so that the amount of air entering from the ambient atmosphere can be regulated.

Upon turning the adjusting element 32 in the opposite direction, such air flow from the ambient atmosphere is prevented.

The space-retaining cup 10 further comprises a lip portion which encircles the base of the breast. The lip portion may be formed of sealing material, such as flexible rubber, and seals the interior space from the ambient atmosphere.

It is believed that the operation of the breast tissue strengthening device is already clear from the above description. By repeatedly displacing the wall portions of the resilient pumping element 18, an increasing vacuum condition is created between the breast tissue and the cup 10. I have found that maintaining the vacuum condition at a level sufficient for the breast to be drawn by about 2 cm into the cup is satisfactory for most applications. By alternately repeating the operations of the adjusting element 32 of the air-admitting means 22 with the air-evacuation means, the breast tissue will be exercised. The breast will be drawn into the cup 10 during the operation of the air-evacuating means; and the breast will return to its original position due to its own muscular tension during the operation of the admitting means 22.

I have found it to be particularly advantageous if the above-mentioned cycle is repeated for 15 minutes, twice a day, preferably once in the morning and once in the evening.

It is well known that the pituitary gland governs the secretion of the endocrine glands and regulates the amount of hormones, such as estrogen and progesterone, in the blood stream. These hormones, amongst other factors, induce the growth of breast tissue. Since the breast has many estrogen-progesterone secreting glands, it is closely linked with the pituitary gland. By reflex-exciting the breast tissue, the pituitary gland will be, in turn, stimulated. The pituitary will now secrete more hormones, thus strengthening and forming the breast tissue.

It will be understood that each of the elements described above, or two or more together, may also find a useful application in other types of biological tissue strengthening devices differing from the type described above.

While the invention has been illustrated and described as embodied in a biological tissue strengthening device, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for strengthening biological tissue, particularly tissue of the female human breast, comprising a shape-retaining cup of transparent synthetic plastic material having an open side for placement over a human breast with clearance so as to define an interior space therewith, said cup having an edge portion at said open side which is formed with a recess having a curvature which curves in direction away from said open side; air-evacuating means including a pumping element operative for evacuating air from said space to thereby draw the breast further into said cup, said pumping element having resilient wall portions bounding an interior region; indicating means on said cup for indicating the distance through which the breast is drawn into said cup; flexible conduit means having an interior passage intermediate said cup and said pumping element; inlet valve means for establishing communication between said interior passage of said flexible conduit means and said interior region of said pumping element, including a substantially ball-shaped valve member and an air flow passage in which said valve member is mounted, said air flow passage having an annular valve seat intermediate said interior passage and said interior region which is normally out of engagement with said valve member so as to admit air from said interior space into said interior region via said interior passage; outlet valve means for establishing communication between said interior region of said pumping element and the ambient atmosphere at the exterior region of said element, including another substantially ball-shaped valve member and another air flow passage in which the latter is mounted, said other air flow passage having an annular valve seat intermediate the interior and exterior regions of said element which is out of engagement with said other valve member when said resilient wall portions are urged towards each other so as to permit air in the interior region of said element to pass towards the exterior region of the latter; and means on said flexible conduit means for adjustably admitting ambient air into said interior space so as to release the vacuum condition in said cup caused by operation of said valve means and said pumping element, said air-admitting means including a bypass passage communicating said interior passage with the ambient atmosphere and being formed with an auxiliary annular valve seat, and an adjustable element mounted for turning movement on said conduit means and having a tapered leading end portion movable between respective positions in which said leading end portion is moved into and out of engagement with said auxiliary valve seat so as to regulate the amount of air entering said interior passage and thereby vent the vacuum in said cup.

2. A device as defined in claim 1, and further comprising friction-retention means on said cup and said inlet valve means for retaining said flexible conduit means.

* * * * *